US007508134B2

(12) United States Patent
Iida

(10) Patent No.: US 7,508,134 B2
(45) Date of Patent: Mar. 24, 2009

(54) SMALL ARC TUBE AND LOW-PRESSURE MERCURY DISCHARGE LAMP

(75) Inventor: Shiro Iida, Kyoto (JP)

(73) Assignee: Panasonic Corporation, Osaka (JP)

( * ) Notice: Subject to any disclaimer, the term of this patent is extended or adjusted under 35 U.S.C. 154(b) by 685 days.

(21) Appl. No.: 11/182,118

(22) Filed: Jul. 15, 2005

(65) Prior Publication Data

US 2006/0022597 A1 Feb. 2, 2006

(30) Foreign Application Priority Data

Aug. 2, 2004 (JP) ..... 2004-226040

(51) Int. Cl.
*H01J 61/12* (2006.01)

(52) U.S. Cl. ..... 313/573; 313/634

(58) Field of Classification Search ..... 313/573, 313/634

See application file for complete search history.

(56) References Cited

U.S. PATENT DOCUMENTS 2,473,878 A * 6/1949 Greiner ..... 362/216
6,057,635 A * 5/2000 Nishimura et al. ..... 313/25
2005/0068775 A1 3/2005 Iida et al.

FOREIGN PATENT DOCUMENTS

JP 2003-263972 9/2003

* cited by examiner

*Primary Examiner*—Toan Ton
*Assistant Examiner*—Hana A Sanei

(57) ABSTRACT

A low-pressure mercury discharge lamp includes: an arc tube made by winding a glass tube into double spiral configuration; a holding member that is in a form of a cylinder with a closed bottom and is for holding the arc tube; an electronic ballast for lighting the arc tube; a case in a cone form for covering the electronic ballast by being fit to a circumferential wall of the holding member; and a globe covering the arc tube. When an inner diameter of the arc tube is represented as Di mm, and tube wall loading of the arc tube is represented as L W/cm$^2$, rectangular coordinates (Di, L) are confined within a range defined by points of: (2.5, 0.31), (4.0, 0.35), (5.5, 0.30), (6.5, 0.19), and (2.5, 0.01).

8 Claims, 7 Drawing Sheets

FIG. 1

ALTERNATIVE OF GENERAL INCANDESCENT LAMP OF 60W

| RELEASE YEAR | CONSUMPTION POWER (W) | ARC-TUBE POWER (W) | MAXIMUM OUTER DIAMETER (mm) | LENGTH (mm) | ARC-TUBE OUTER DIAMETER (mm) | ARC-TUBE INNER DIAMETER (mm) | DISCHARGE PATH LENGTH (mm) | TUBE WALL LOADING ($W/cm^2$) | LAMP EFFICIENCY (lm/W) |
|---|---|---|---|---|---|---|---|---|---|
| 1996 | 14 | 12.7 | 60 | 135 | 12.0 | 10.0 | 260 | 0.16 | 57.9 |
| 2000 | 13 | 11.8 | 60 | 122 | 10.8 | 9.2 | 300 | 0.14 | 62.3 |
| 2004 | 12 | 10.9 | 55 | 110 | 9.0 | 7.4 | 400 | 0.12 | 67.5 |

SMALL ARC TUBE AND LOW-PRESSURE MERCURY DISCHARGE LAMP

This application is based on application No. 2004-226040 filed in Japan, the contents of which are hereby incorporated by reference.

BACKGROUND OF THE INVENTION (1) Field of the Invention

The present invention relates to an arc tube to be used for a low-pressure mercury discharge lamp, the arc tube having an arc-tube body whose interior space is for forming one discharge path and electrodes provided at ends of the arc-tube body that correspond to ends of the interior space. The present invention also relates to a low-pressure mercury discharge lamp employing the arc tube.

(2) Related Art

Recently, in this energy saving era, with a view toward saving energy also in the lighting field, more and more compact self-ballasted fluorescent lamps are being developed for widespread use as energy-efficient light sources replacing incandescent lamps.

Compact self-ballasted fluorescent lamps consume less power than incandescent lamps, which is advantageous in energy saving. However, being larger than incandescent lamps in size, compact self-ballasted fluorescent lamps have not become widespread because sometimes they cannot be mounted to an existing illumination device, and other times even if they fit the illumination device, a tip thereof protrudes from the illumination device.

In view of this problem, so as to bring compact self-ballasted fluorescent lamps into widespread use, both of size reduction comparable to that of incandescent lamps and further energy saving for lamp efficiency enhancement have been considered (e.g. Japanese Laid-open Patent Application No. 2003-263972).

FIG. 1 shows main dimensions, lamp efficiency, etc. of compact self-ballasted fluorescent lamps (corresponding to incandescent lamps of 60 W type) respectively released in the years of 1996, 2000, and 2004. Note that an incandescent lamp of 60 W type has a maximum outer diameter (corresponding to "D1" in FIG. 2) of 60 mm and a length (corresponding to "L1" in FIG. 2) of 110 mm.

As shown in FIG. 1, the compact self-ballasted fluorescent lamp released in 1996 has a maximum outer diameter of 60 mm and a length of 135 mm, being substantially larger than an incandescent lamp. The lamp efficiency of this compact self-ballasted fluorescent lamp is 57.9 lm/W.

Compared to this, the compact self-ballasted fluorescent lamp released in 2004 has a maximum outer diameter of 55 mm and a length of 110 mm, attaining size reduction up to the same level as an incandescent lamp. The lamp efficiency of this compact self-ballasted fluorescent lamp is 67.5 lm/W, showing 17% improvement compared to the lamp released in 1996.

The size reduction for these lamps was pursued by narrowing the glass tube constituting an arc tube. Meanwhile, the energy saving for these lamps was pursued by narrowing the arc tube and also by increasing the length of its discharge path (distance between electrodes) thereby reducing the tube wall loading. Here, tube wall loading is obtained by dividing the arc-tube power by an inner surface area of the glass tube portion corresponding to the discharge path.

In this way, the compact self-ballasted fluorescent lamp has achieved size reduction up to the level of an incandescent lamp, as well as high lamp efficiency.

However, in the recent market of light bulbs, it is mini krypton lamps that are becoming mainstream, which are smaller than incandescent lamps having been mainstream in the market. Regarding the dimensions of a mini krypton lamp in the case of 60 W type for example, the maximum outer diameter is 35 mm and the length is 67 mm. Note that the luminous flux of a mini krypton lamp of 60 W type is 810 lm, just the same as the luminous flux of incandescent lamps and compact self-ballasted fluorescent lamps stated above.

In such a circumstance, in an attempt to obtain a small self-ballasted fluorescent lamp having a size comparable to that of a mini krypton lamp, the stated conventional method of narrowing the glass tube and increasing the length of the discharge path has been pursued. However, it has not been successful because the length of the glass tube became too long while narrowing the glass tube.

SUMMARY OF THE INVENTION

The present invention, having been conceived in light of the aforementioned problems, has an object of providing a small arc tube while maintaining the conventional level of lamp efficiency and luminous flux, and a low-pressure mercury discharge lamp employing such an arc tube.

So as to achieve the above-stated object, an arc tube according to the present invention includes an arc-tube body whose interior space is for forming one discharge path; and electrodes provided at ends of the arc-tube body that correspond to ends of the interior space, where when an inner diameter of the arc tube is represented as Di mm, and tube wall loading of the arc tube is represented as LW/cm$^2$, rectangular coordinates (Di, L) are confined within a range defined by straight lines connecting points of: (2.5, 0.31), (4.0, 0.35), (5.5, 0.30), (6.5, 0.19), and (2.5, 0.01), in the stated order.

It should be noted here that, during some arc-tube forming processes, a gaseous substance under pressure control is enclosed into a glass tube, while the glass tube is in a softened state by being heated or soon. For an arc tube generated having undergone such a process, the inner diameter of the arc tube is larger than the inner diameter of the glass tube. On the contrary, if such an arc-tube forming process is not adopted, such a difference of the inner diameter between an arc tube and a glass tube will not be generated. In light of the above, in the present invention, "the inner diameter of the arc tube" means an inner diameter of an arc tube completed after the electrodes have been provided to the ends of the arc-tube body. In other words, in the arc tube, the internal space of the arc-tube body has is already a discharge path.

According to the above-stated structure in which the inner diameter of the arc tube and the tube wall loading of the arc tube fall within the above-stated range, the lamp efficiency is maintained as the same level as in a conventional compact self-ballasted fluorescent lamp even when the tube wall loading is set at a high value. Accordingly, it becomes possible to set tube wall loading to a higher value than in a conventional case. This helps reduce the size of an arc tube.

Here, a structure is also possible in which the arc-tube body is made of a glass tube, and is in a configuration in which at least a part of the glass tube is wound around a predetermined axis.

According to the stated structure, a small arc tube is obtained.

Here, a structure is also possible in which the arc-tube body is made of a glass tube, and is in a double spiral configuration in which the glass tube is wound around a predetermined axis from a substantial center to both ends of the glass tube.

According to the stated structure, the arc-tube body is in a double spiral configuration. This facilitates further reduction in size of an arc tube. In addition, the maximum dimensions of the arc tube correspond to those of a cylinder having an outer diameter of 35 mm and a length of 40 mm. Therefore, if a lamp is created using this arc tube, the adaptability of this lamp to the existing illumination devices for a mini krypton lamp of 60 W type can be 70%.

In addition, a low-pressure mercury discharge lamp according to the present invention includes an arc tube of claim 1; a base; and a lighting circuit for lighting the arc tube using power supplied from an external power source through the base. It is also possible that a low-pressure mercury discharge lamp according to the present invention includes an arc tube of claim 1; and a base.

According to the stated structures, a lamp can maintain high lamp efficiency, as well as having a small entire size because it adopts a small arc tube.

BRIEF DESCRIPTION OF THE DRAWINGS

These and other objects, advantages and features of the invention will become apparent from the following description thereof taken in conjunction with the accompanying drawings that illustrate a specific embodiment of the invention. In the drawings:

FIG. 1 is a diagram showing main dimensions, lamp efficiency etc. of conventional compact self-ballasted fluorescent lamps (corresponding to incandescent lamps of 60 W type);

DESCRIPTION OF THE PREFERRED EMBODIMENTS

First Embodiment

Figure 2:
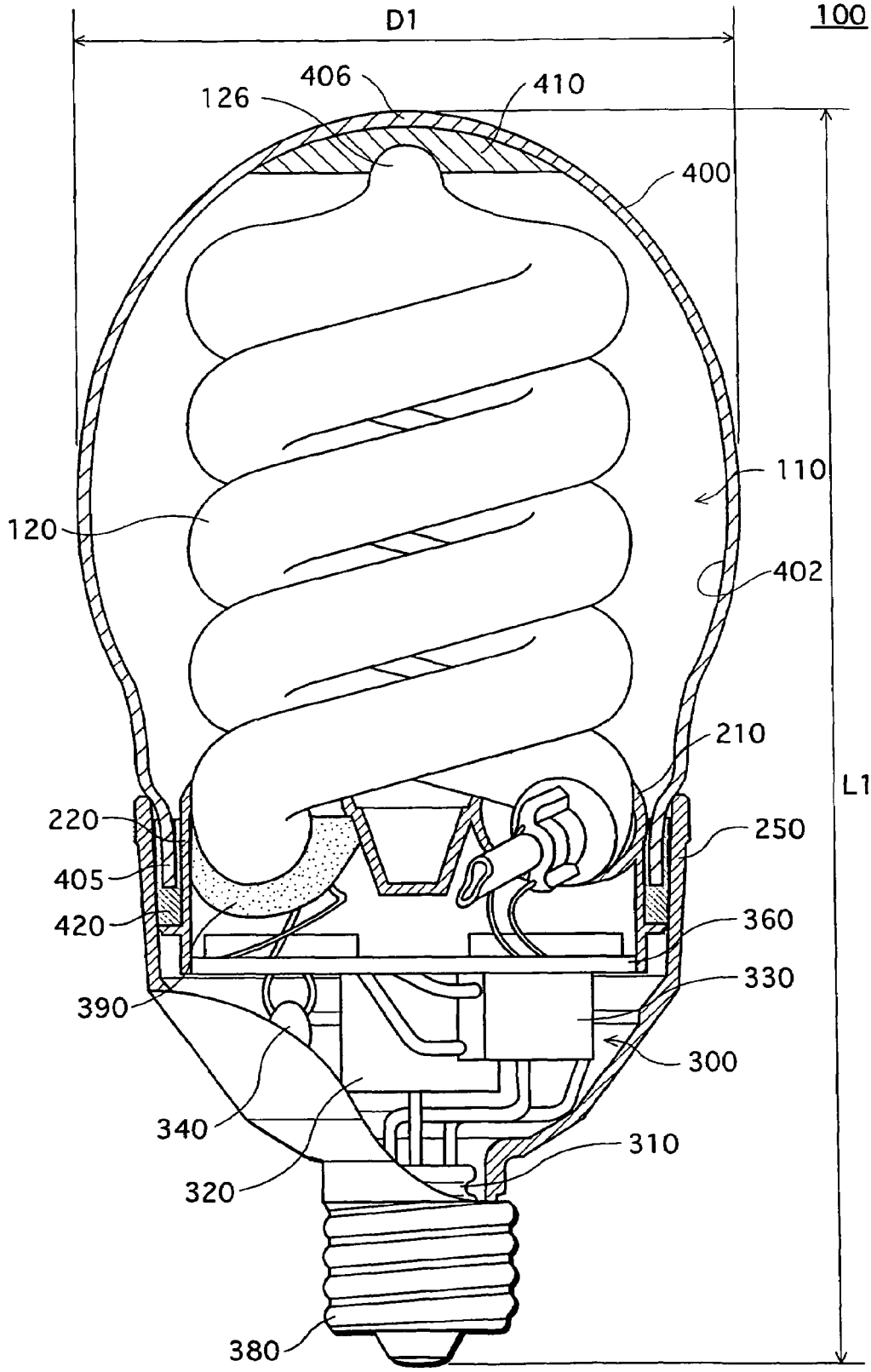
FIG. 2 is an overall view of a lamp according to a first embodiment, which is partly cut away to show the inside.

The following describes a case where the present invention is applied to an arc tube of a compact self-ballasted fluorescent lamp (hereinafter simply "lamp") being an alternative of a mini krypton lamp of 60 W type, by referring to the drawings.

1. Structure (1) Overall structure

FIG. 2 is an overall view of the lamp according to the first embodiment, which is partly cut away to show the inside.

As FIG. 2 shows, a lamp 100 is made up of: an arc tube 110 made by winding a glass tube 120 into a double spiral configuration, a holding member 210 for holding the arc tube 110, an electronic ballast 300 for lighting the arc tube 110, a case 250 for covering the electronic ballast 300 by being mounted to the holding member 210, and a globe 400 for covering the arc tube 110.

The holding member 210 is for example in a form of a cylinder with a closed bottom, including a circumferential wall 220 and a bottom wall for closing one end of the circumferential wall 220. At the bottom wall, a pair of insertion openings are provided through which the ends of the arc tube are inserted.

The electronic ballast 300 is in a series inverter method and is structured by a plurality of electronic/electric components such as capacitors 310, 330, 340, and a choke coil 320. A substrate 360, to which these electronic/electric components are attached, is attached to the holding member 210. Note that the conversion efficiency of the electronic ballast 300 is 91%.

The case 250 is for example in a cone form. One of the openings of the case 250 that has a larger diameter is fit to the circumferential wall 220 of the holding member 210, thereby storing therein the electronic ballast 300. To the other opening of the case 250 that has a smaller diameter, a base 380 of a same type as an incandescent lamp is attached.

As is the case with a bulb used for an incandescent lamp, the globe 400 is made from a glass material having a high flexibility in its design, and is shaped like an eggplant (so called A-shape). A diffusion coating 402 is applied to the inner surface of this globe 400. The main component of the diffusion coating 402 is calcium carbonate. Note that the globe 400 is not limited to the A-shape, and can also be a G-shape or a T-shape, if it is not necessary to take into account the size of the lamp 100 and so on. It is also possible to produce the lamp 100 without any globe.

The inner wall of the case 250 is fit to the circumferential wall 220 of the holding member 210. An end 405 of the globe 400 at the opening side is fixed between the inner wall of the case 250 and the circumferential wall 220, with an adhesive 420 filled between the holding member 210 and the case 250.

The inner surface of a top part 406 of the globe 400 (very top in FIG. 2) is thermally connected to a convex portion 126 of the top of the arc tube 110 (very top in FIG. 2), by means of a thermally conductive medium 410 (e.g. silicone resin). This is for, while the lamp is lit, conducting heat from the arc tube 110 through the thermally conductive medium 410 to the globe 400, and further for dissipating the heat from the globe 400. This helps setting the temperature of the arc tube 110 during the lamp's lighting to an optimal range (about 60-65 degree C.), within which the maximum range of luminous flux is obtained.

(2) Arc Tube

Figure 3:
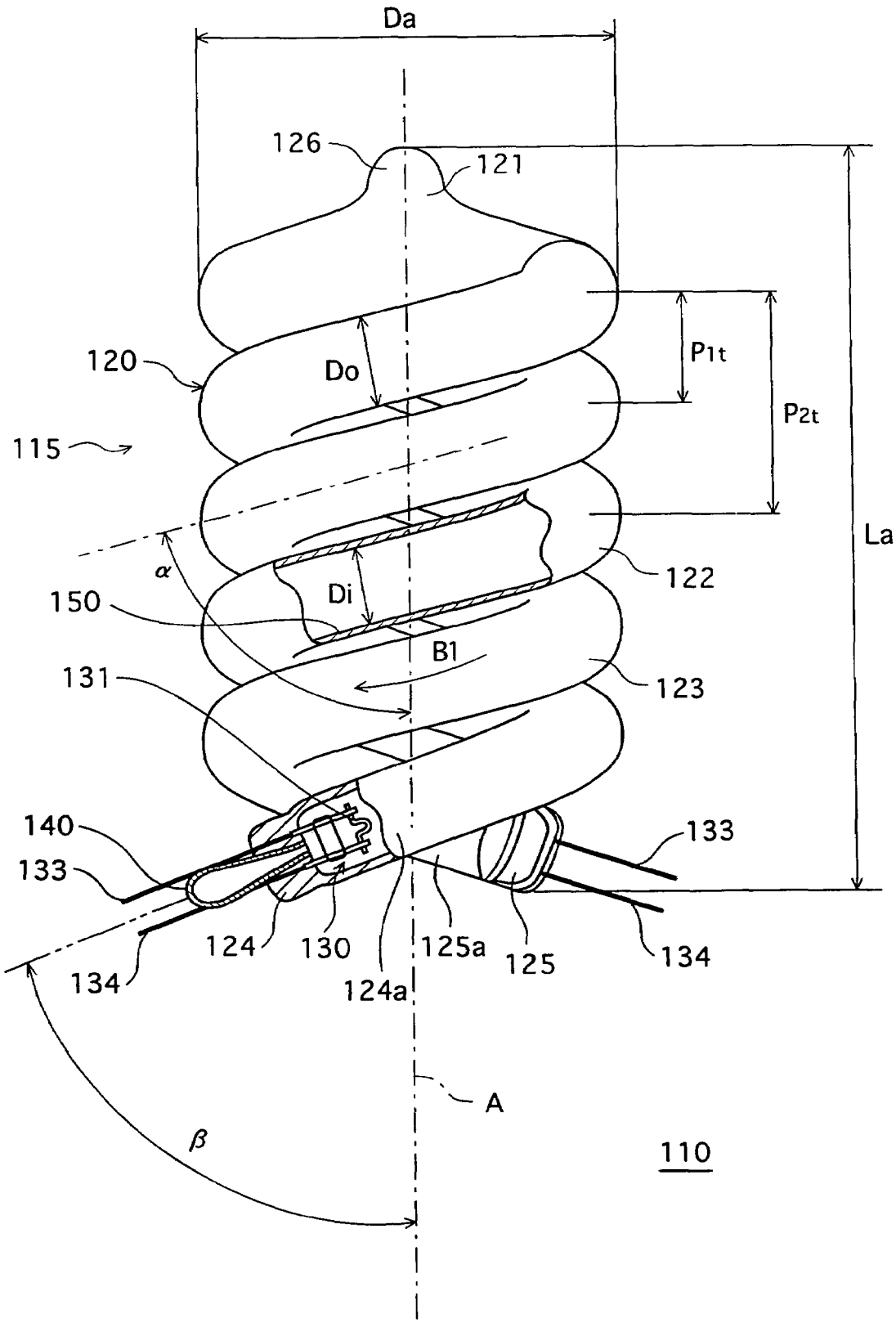
FIG. 3 shows an arc tube, part of which is cut away to show the inside.

FIG. 3 shows an arc tube, part of which is cut away to show the inside.

As shown in FIG. 3, the arc tube 110 is in a double spiral configuration having a turning part 121 and two winding parts 122 and 123. The turning part 121 is formed by bending the glass tube 120 at the center thereof, and the winding parts 122 and 123 are formed by winding the glass tube 120 from the turning part 121 towards both ends 124 and 125 around the axis A (occasionally referred to as "predetermined axis" in the present invention). Hereinafter, this glass tube 120 in double spiral configuration is referred to as "arc-tube body 115". In addition, a direction parallel to the axis A is referred to as "axial direction".

From the turning part 121 to predetermined positions respectively within the winding parts 122 and 123, the glass tube 120 is wound substantially in a first spiral pitch. The predetermined positions are hereinafter referred to as "pitch enlarging position", and a concrete location thereof is detailed later. From the pitch enlarging positions to the respective ends 124 and 125, the glass tube 120 is wound in a second spiral pitch that is larger than the first spiral pitch, so that each end 124 (125) will be apart from a neighboring portion of the glass tube 120 in the axial direction. Hereinafter, the portions of the glass tube 120 from the pitch enlarging positions to the respective ends 124 and 125 are referred to as "end-vicinity portions 124*a* and 125*a*". Please note that each of the first and second spiral pitches means a distance between the centers of the cross sections of two glass tube portions adjacent to each other in the axial direction (P1*t* in FIG. 3).

In other words, from the turning part 121 to the pitch enlarging positions, the glass tube 120 is wound by being tilted with an angle α with respect to the axis A. On the other hand, the end-vicinity portions 124*a* and 125*a* are respectively wound by being tilted with an angle β that is smaller than the angle α, with respect to the axis A. Hereinafter, the angle α and the angle β are referred to as "winding angle α" and "winding angle β".

At each end of the glass tube 120, an electrode 130 provided. The electrode 130 is made up of a filament coil 131 made of tungsten, and a pair of lead wires 133 and 134 that support the filament coil 131 by way of a so-called beads glass mounting method. Note that the ends of the glass tube 120 (or ends of the arc-tube body) to which electrodes 130 are to be provided correspond to the ends of the internal space of the arc tube 110. Each filament coil 131 is filled with an electron emissive material.

An exhaust tube 140 is fixed to the end 124 of the glass tube 120, at the time when a corresponding electrode 130 is provided. The exhaust tube 140 is used for producing a vacuum within the arc-tube body 115, and for enclosing such as mercury and a buffer gas that are detailed later. After completion of the evacuation of the glass tube 120 and enclosure of such as mercury and a buffer gas, the portion of the exhaust tube 140 positioned external to the glass tube 120 is processed in a cut-off method, for example, to seal the arc-tube body 115.

Mercury may be enclosed in any form as long as it presents the same mercury vapor pressure characteristics during the lamp's lighting as those of mercury enclosed in the single form. For example, amalgam forms such as zinc mercury and tin mercury may be used. Note that at the tip of the arc tube 110 (namely, at the turning part 121), a convex portion 126 is formed whose temperature will be the lowest within the arc tube 110 while the lamp is lit. The vapor pressure of mercury within the arc tube 110 is uniquely defined by the temperature at this coldest spot.

The internal surface of the arc-tube body 115 is applied with a phosphor 150. This phosphor 150 is in three band, and is produced by mixing three rare-earth phosphors respectively emitting red ($Y_2O_3$:Eu), green ($LaPO_4$:Ce, Tb), and blue ($BaMg_2Al_{16}O_{27}$:Eu, Mn), for example.

The arc tube 110 is held by the holding member in the following way. Ends of the arc tube 110 (i.e. the ends 124 and 125 of the glass tube 120) are inserted into the insertion openings of the bottom wall of the holding member 210, and are fixed to the inner surface of the holding member 210 with an adhesive 390.

(3) Concrete Example

The following describes a case where the present invention is applied to a lamp having a globe, which corresponds to a mini krypton lamp of 60 W type.

A lamp 100 requires the quantity of light comparative to the quantity that a mini krypton lamp of 60 W type requires. In view of this, an arc tube 110 is designed so that the number of winding for the entire winding parts 122 and 123 is substantially 4.5 in total.

A maximum outer diameter D1 of the lamp 100 is 45 mm, and the length L1 thereof is 90 mm, which indicates 10 mm reduction in maximum outer diameter and 20 mm reduction in length compared to a conventional compact self-ballasted fluorescent lamp (i.e. a maximum outer diameter of 55 mm and a length of 110 mm; see FIG. 1). As is clear from this, the lamp 100 is substantially smaller than a conventional compact self-ballasted fluorescent lamp.

The dimensions of the glass tube 120 for the arc tube 110 are: an inner diameter Di of 4.0 mm, and an outer diameter Do of 5.6 mm. The dimensions of the arc tube 110 are: an outer diameter Da of 35 mm and a length La of 40 mm.

In addition, the length of the discharge path in the arc tube 110 is 400 mm, at which tube wall loading is set as 0.22 W/cm$^2$. Note that the glass tube 120 is made of soft glass such as strontium-barium silicate glass, for example.

In the glass tube 120 in double spiral configuration, the pitch enlarging positions are respectively set 90 degrees from the respective ends 124 and 125 of the glass tube 120 towards the turning part 121.

From the turning part 121 to the pitch enlarging positions of the glass tube 120, a pitch p2*t* between any two winding parts 122 that are adjacent to each other in the axial direction is 13.2 mm. Likewise, a pitch p2*t* between any two adjacent winding parts 123 that are adjacent to each other in the axial direction is 13.2 mm. A pitch p1*t* between any of winding part 122 and winding part 123 that are adjacent to each other in the axial direction is 6.6 mm.

Accordingly, a minimum gap between two portions of the glass tube 120 adjacent to each other in the axial direction is about 1.0 mm. Note that the preferable range for this gap is 3.0 mm or below. This is because if this gap becomes larger than 3.0 mm, the length of the arc tube 110 becomes long, as well as causing brightness inconsistency because adjacent portions of the glass tube 120 will be apart in the axial direction.

The winding angle α for the range of the turning part 121 to the pitch enlarging positions of the glass tube 120 is approximately 76.7 degrees. The winding angle β for the range of the pitch enlarging positions to the ends 124 and 125 is approximately 69.2 degrees.

In the arc-tube body 115, argon as a buffer gas is enclosed at 400 Pa, besides about 3 mg of mercury.

When the lamp 100 was lit, the luminous flux emitted therefrom was 830 lm, and the lamp efficiency was 69.2 lm/W. The rating life of the lamp 100 was 4500-5000 hours, which is longer than the rating life of a conventional mini krypton lamp (2000 hours) by about 2.3 to 2.5 times.

The lamp 100 is larger than a mini krypton lamp of 60 W type that the lamp 100 aims to replace, however is smaller than an incandescent lamp of 60 W type having been conventionally used. The adaptability of the lamp 100 to the illumination devices for a mini krypton lamp is 65%. Compared to this, the adaptability of a conventional self-ballasted fluorescent lamp (i.e. the lamp released in the year 2004 in FIG. 1) corresponding to an incandescent lamp of 60 W is 20%-30%. Therefore, the lamp 100 has dramatically improved adaptability with respect to the illumination devices for mini krypton lamps.

2. Reduction in Size and Power Saving of the Lamp (1) What was Considered

So as to make a compact self-ballasted fluorescent lamp that can be used as an alternative of a mini krypton lamp, the inventors of the present invention initially tried to apply a method conventionally used to reduce the size of lamps, namely, narrowing the glass tube and reducing the tube wall loading. However, as the glass tube gets narrow, the discharge path becomes long as well. Therefore, it was not possible to achieve dramatic size reduction for the entire arc tube. The form and structure of the arc tube was also reconsidered, but the inventors could not find a better form or structure than the current spiral type.

As already described above with reference to FIG. 1, the lamp released in the year of 2004 has substantially smaller size than the lamp released in the year of 2000. This is not only because of lowering of the tube wall loading by narrowing the glass tube, but also because of change into a spiral type as in the embodiment from the so-called 3U-type that is a combination of three glass tubes in U-shape. Downsizing is easier for a spiral type arc tube than for a 3U-type, because in a spiral type arc tube, the gap between adjacent glass tubes is smaller, and even with a long discharge path than a 3U-type, more size reduction is possible with a spiral type.

As stated above, what was conventionally performed for size reduction and energy saving for a lamp is to narrow the inner diameter of the arc tube, and to increase the length of the discharge path thereby reducing the tube wall loading for the arc tube.

This is because in principle, when the inner diameter of a glass tube is narrowed, the electron temperature of positive column plasma increases, thereby increasing the emission efficiency of ultraviolet radiation (wavelength of 253.7 nm) from mercury, which leads to improvement in lamp efficiency.

On the other hand, when the discharge path is made to be long, the impedance of the arc tube will be large and the lamp's current density within the glass tube is lowered. In this respect too, the electron temperature is raised to enhance the lamp efficiency.

To put these ideas in the reverse way, it has been considered that if the discharge path is not made to be long, the lamp's current density becomes high, which will cancel out the improvement in lamp efficiency realized by having a thinner glass tube.

After studies, however, the inventors have found a quite unexpected fact contrary to the conventionally believed idea. That is, when the inner diameter of the arc tube is smaller than 7.4 mm, the lamp efficiency will not decrease much even if the length of the discharge path is increased up to 400 mm equivalent to the discharge path of a conventional arc tube and so the tube wall loading and the lamp's current density get substantially higher.

Figure 4:
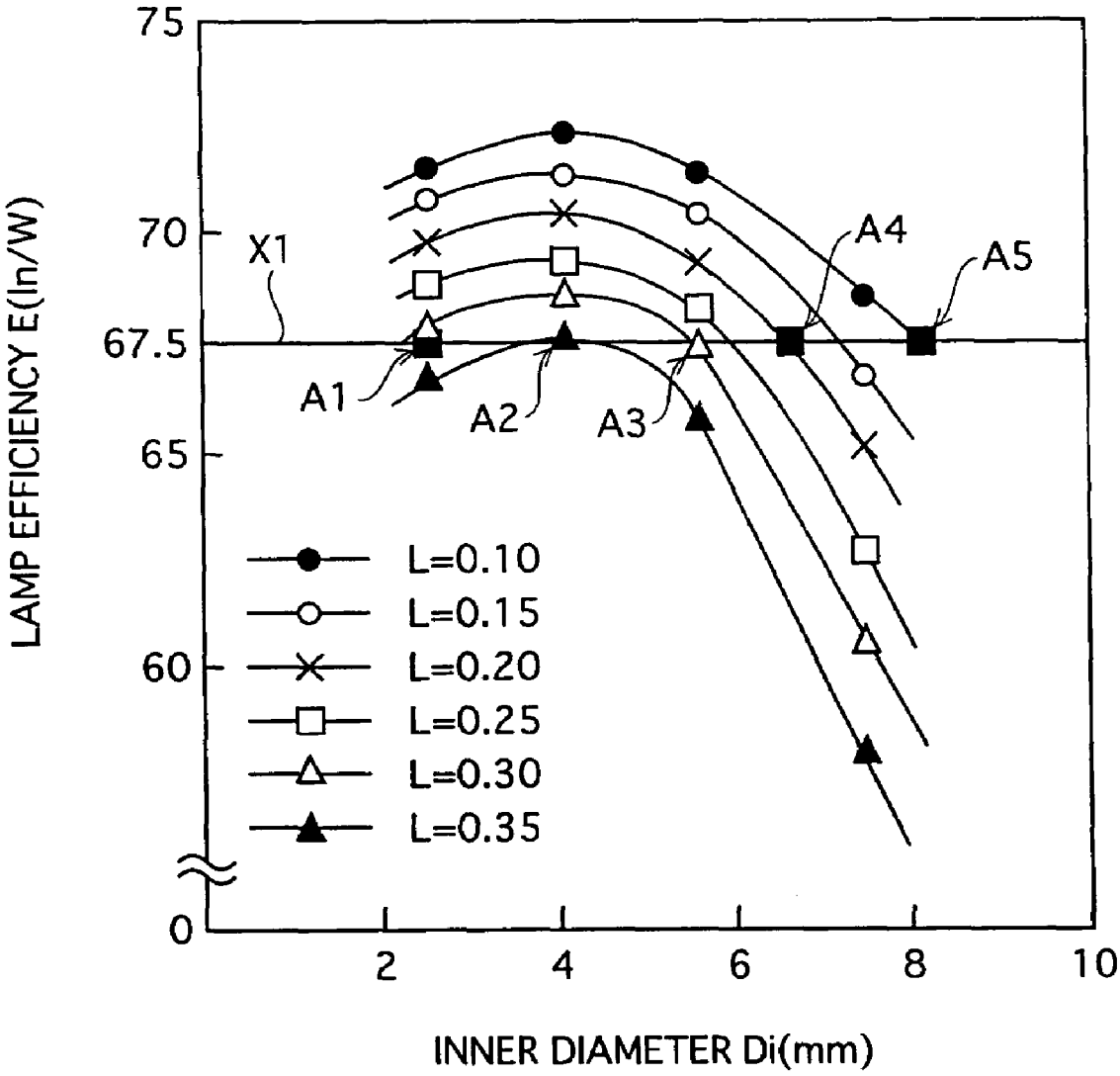
FIG. 4 is a diagram showing a relation between the inner diameter Di and the lamp efficiency E for each varied value of the tube wall loading of an arc tube.

FIG. 4 is a diagram showing a relation between the inner diameter Di and the lamp efficiency E for each varied value of the tube wall loading of an arc tube. This diagram shows a result of lighting experiments performed using several arc tubes, created based on the alternatives of five settings for the tube wall loading L ($W/cm^2$) of an arc tube, namely, 0.10, 0.15, 0.20, 0.25, and 0.30, and four values of inner diameter Di (mm), namely, 2.5, 4.0, 5.5, and 7.4. Note that the length of discharge path is determined so that a predetermined level of tube wall loading will be produced with a given inner diameter for a corresponding arc tube.

The inner diameter Di of the arc tubes used in the experiments is no smaller than 2.5 mm. This is because when the inner diameter Di of an arc tube is smaller than 2.5 mm, then it becomes difficult to insert filament coils to the ends of the arc-tube body, or to provide electrodes for the ends of the arc-tube body.

The lighting experiments were conducted at room temperature with the base of a lamp oriented upward. In addition, argon is enclosed in each arc tube as a rare gas at 400 Pa, and the lamp's consumption power and the arc tube's consumption power are respectively 12 W and 10.9 W.

From FIG. 4 showing the result of the experiments, when the inner diameter Di of an arc tube is 4.0 mm or above, the lamp efficiency improves as the tube wall loading gets smaller and as the inner diameter Di gets smaller. In other words, when the inner diameter Di is held constant in the range of 4.0 mm or above, the lamp efficiency E will be higher as the tube wall loading L gets smaller. Conversely, when the tube wall loading L is held constant and the inner diameter Di is in the range of 4 mm or above, the lamp efficiency E improves as the inner diameter Di of the arc tube gets smaller. This result agrees with the conventional idea, and is more pronounced where the inner diameter Di is larger than 5.5 mm.

The inventors furthered the experiments, and found the following phenomenon. That is, when the tube wall loading L is held constant, the maximum value of the lamp efficiency E is produced when the inner diameter Di of the arc tube is about 4 mm. In addition, when the inner diameter Di of the arc tube is held constant and the tube wall loading L is varied, the rate of change in the lamp efficiency E is reduced where the inner diameter Di of the arc tube is within the range of 2.5 mm to 5.5 mm inclusive.

To summarize the above discussion, it is newly discovered that the rate of reduction of lamp efficiency E, when there is a large increase in the tube wall loading L, is smaller if the inner diameter Di of the arc tube falls within the range of 2.5 mm to 5.5 mm, than if the inner diameter Di is larger than 5.5 mm (e.g. when the inner diameter Di is 7.4 mm).

Therefore, when the inner diameter Di is in the range of 2.5 mm to 5.5 mm, the lamp efficiency E of 67.5 $W/cm^2$ that stands comparison with the conventional case is maintained even if the tube wall loading L is increased to about 0.3 $W/cm^2$ (compared to a conventional value of 0.1 $W/cm^2$).

This means that the discharge path of the arc tube can be reduced to ⅓ of a conventional case. This not only means a substantial length reduction for a glass tube, but also directly leads to reducing the size of an arc tube and of a lamp.

The following describes the reasons of the stated phenomenon.

As stated above, a peculiar phenomenon has been confirmed when the inner diameter Di falls within the range of 2.5 mm to 5.5 mm. This peculiar phenomenon is considered attributable to the fact that the ratio of lamp efficiency increase due to narrowing of the inner diameter Di within this range has exceeded the lamp efficiency decrease due to the increase in tube wall loading L and in current density. More specifically, in principle, the increase rate of the electron temperature of positive column plasma due to narrowing of the inner diameter Di surpasses the decrease rate of the electron temperature due to increase in the lamp's current density.

(2) Arc Tube'S Inner Diameter and Tube Wall Loading

The inventors have performed examinations for obtaining an alternate lamp of the mini krypton lamps. Specifically, they set as objectives to attain lamp efficiency of 67.5 lm/W or above, and lamp's length L1 of 100 mm or below. The reason for setting the stated objectives is to obtain the same lamp efficiency level as the existing compact self-ballasted fluorescent lamp of 60 W type, and to achieve the lamp's adaptability of 60% or above to the existing illumination device for mini krypton lamps. Note that according to the inventor's investigation, a lamp's length L1 should be 100 mm or below so as to obtain adaptability of at least 60% to the existing illumination device for mini krypton lamps.

A. Lamp Efficiency

In FIG. 4, the lamp efficiency E of 67.5 lm/W or above is obtained in the range above the line X1. That is, for each value of inner diameter Di, the lamp efficiency E of 67.5 lm/W or above will be obtained if the tube wall loading L is smaller than a corresponding value on the line X1.

When the inner diameter is Di mm and the tube wall loading is L W/cm$^2$, the rectangular coordinates (Di, L) of A1, A2, A3, A4, and A5, which are the five points on the line X, are expressed as follows: A1 (2.5, 0.31), A2 (4.0, 0.35), A3 (5.5, 0.30), A4 (6.5, 0.19), and A5 (8.0, 0.10).

Figure 6:
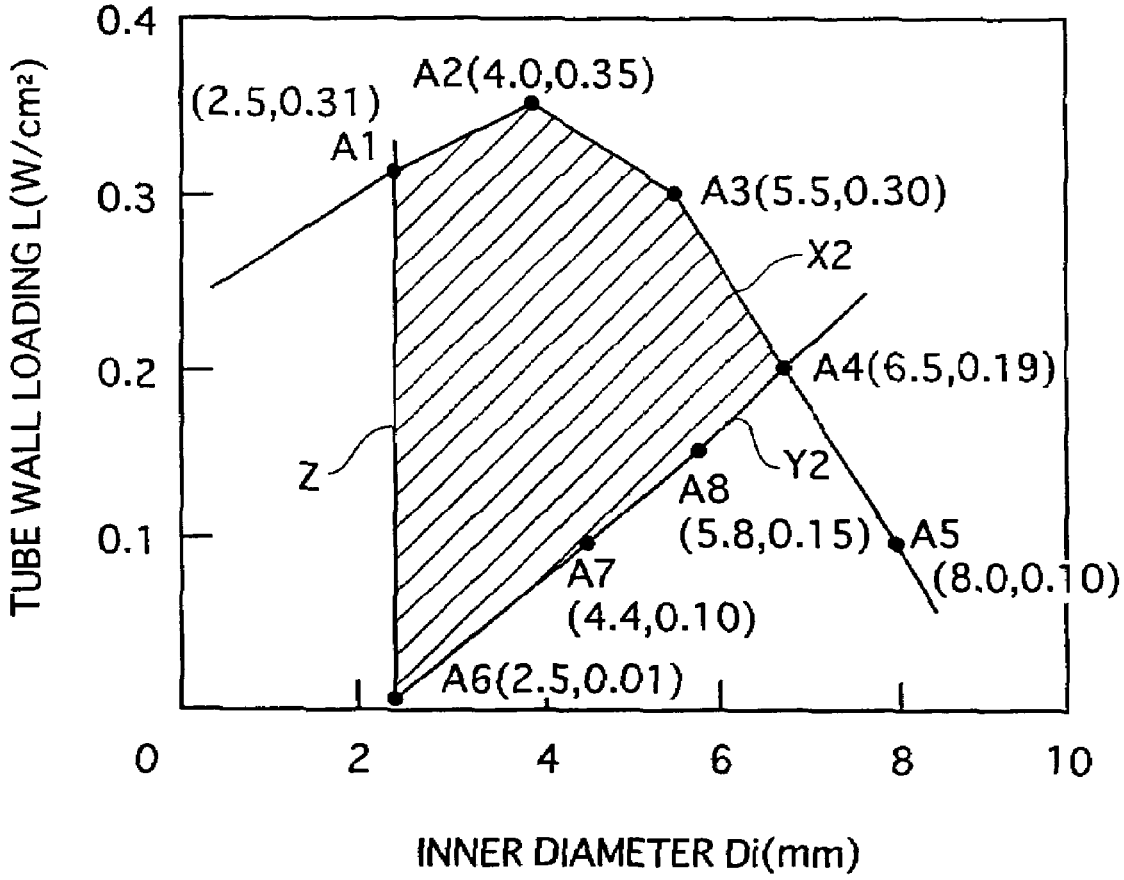
FIG. 6 is a diagram showing a relation between the inner diameter and the tube wall loading.

The points A1-A5 are plotted in FIG. 6, with the horizontal axis representing the inner diameter Di and the vertical axis representing the tube wall loading L. The line X2 connecting all the points A1-A5 corresponds to the line X1 in FIG. 4. On or below the line X2, the lamp efficiency of 67.5 lm/W or above is assured.

B. Size

Figure 5:
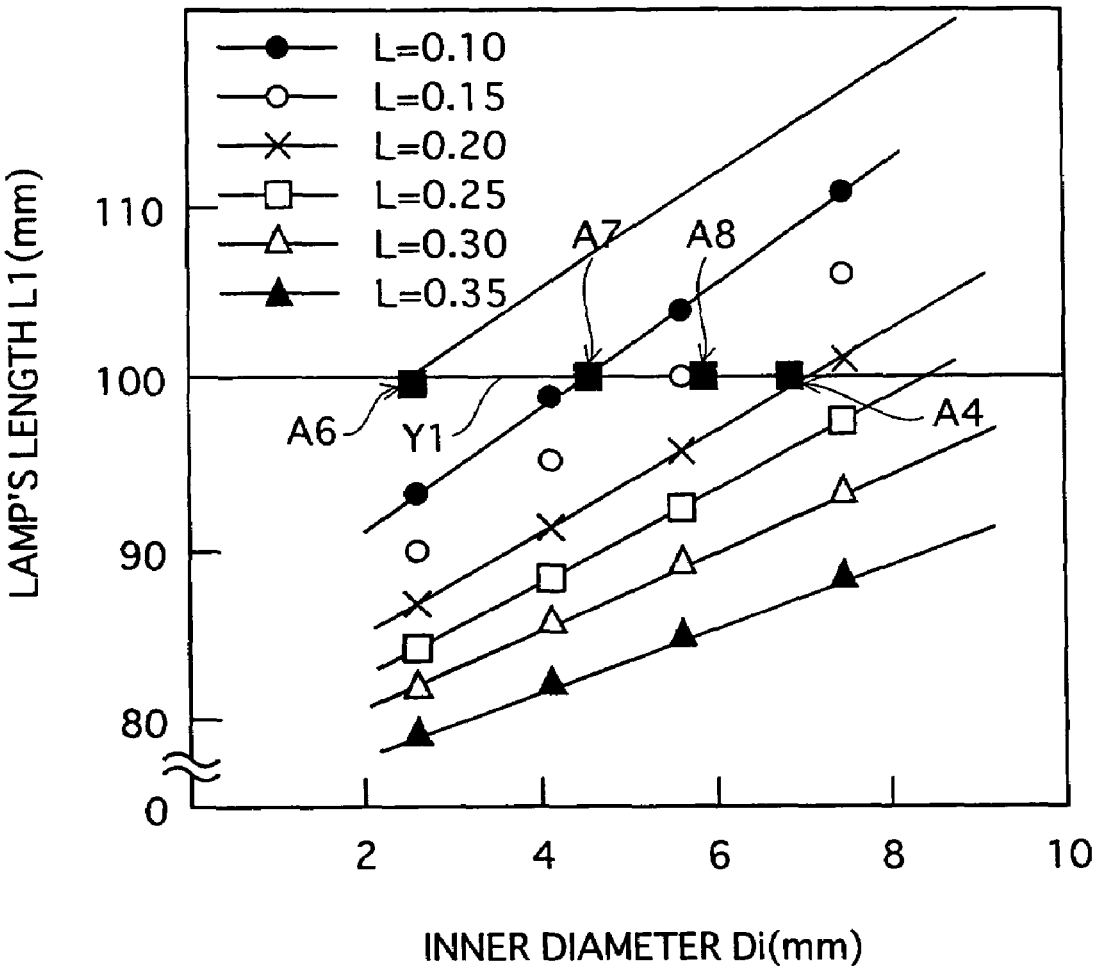
FIG. 5 is a diagram showing a relation between the inner diameter Di and the lamp's length L for each varied value of tube wall loading of an arc tube.

FIG. 5 is a diagram showing a relation between the inner diameter Di and the lamp's length L1 for each varied value of tube wall loading L. This diagram shows a result of measuring the length of lamps created using arc tubes described in the above description on the structure, based on the alternatives of five settings for the tube wall loading L (W/cm$^2$), namely, 0.10, 0.15, 0.20, 0.25, and 0.30, and four values of inner diameter Di (mm), namely, 2.5, 4.0, 5.5, and 7.4. Note that the length of discharge path is determined so that a predetermined level of tube wall loading will be produced with a given inner diameter for a corresponding arc tube. Note that the length L1 corresponding to the tube wall loading L of 0.35 W/cm$^2$ is estimated based on the experimental results for the stated four values of the tube wall loading L, and not an actual experimental result.

The length L1 of a lamp becomes 100 mm or below in the range below the line Y1 shown in FIG. 5. In other words, when an inner diameter Di and a tube wall loading L are included in the range below the line Y1 of FIG. 5, a corresponding length L1 of a lamp is 100 mm or below.

The rectangular coordinates (Di, L) of points A6, A7, and A8, which are on the line Y1, are expressed as follows: A6 (2.5, 0.01), A7 (4.4, 0.10), and A8 (5.8, 0.15).

The points A6-A8 are plotted in FIG. 6, with the horizontal axis representing an inner diameter Di and the vertical axis representing the tube wall loading L. The line Y2 connecting the points A4, A6-A8 corresponds to the line Y1 in FIG. 5. On or above the line Y2, the lamp's length L1 of 100 mm or below is assured.

(3) Summary

To summarize the above results with reference to FIG. 6, on or below the line X2, the lamp efficiency is 67.5 lm/W or above, and on or above the line Y2, the lamp's length L1 is 100 mm or below.

Here, it should be noted that the inner diameter Di of the arc tube is preferably 2.5 mm or above, so as to enable insertion of filament coils to the ends of the arc-tube body and provision of electrodes for the ends of the arc-tube body. The range corresponding to this inner diameter Di is shown as the right-hand area of the line Z (including the line Z).

Accordingly, so as to produce lamp efficiency E of 67.5 lm/W or above and lamp's length L1 of 100 mm or below, the inner diameter Di and the tube wall loading L should fall within the area defined by the line X2, the line Y2, and the line Z.

Second Embodiment

The following describes a case where the present invention is applied to an arc tube of a compact self-ballasted fluorescent lamp (hereinafter simply "lamp") being an alternative of a mini krypton lamp of 40 W type.

1. Structure

Figure 7:
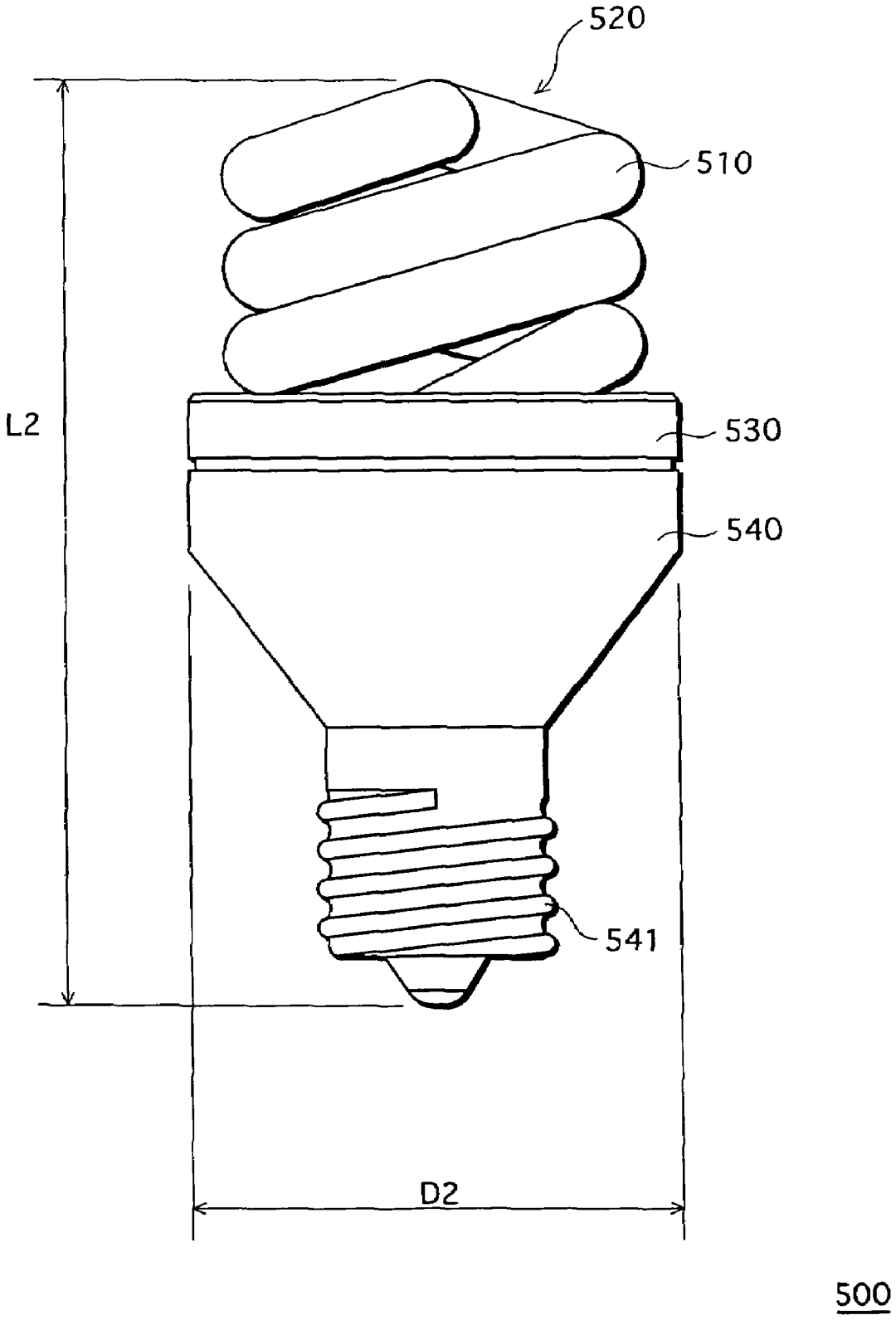
FIG. 7 is an overall view of a lamp according to a second embodiment.

FIG. 7 is an overall view of the lamp according to the second embodiment.

As FIG. 7 shows, a lamp 500 is made up of: an arc tube 520 made by winding a glass tube 510 into a double spiral configuration, a holding member 530 that is in a form of a cylinder with a closed bottom and is for holding the arc tube 520, an electronic ballast for lighting the arc tube 520 (not illustrated), a case 540 in a cone form for covering the electronic ballast by being fit to the holding member 530, and an E-type base 541 provided for the case 540 at an opposite side to the side in which the arc tube 520 is provided.

In principle the lamp 500 has the same structure as the lamp 100 described in the first embodiment. Therefore, the detailed explanation on the components are not given here. In structure, the lamp 500 is different from the lamp 100 in that the lamp 500 does not have a globe for covering the arc tube 520 (globe-less type).

Likewise, the basic structure of the arc tube 520 conforms to that of the arc tube 110 for the lamp 100. If this arc tube 520 has the inner diameter Di and the tube wall loading L falling within the range described in FIG. 6, it is particularly effective in obtaining a small and energy-saving compact self-ballasted fluorescent lamp suitable for an alternative of a mini krypton lamp of 40 W type.

In general, the arc tube 520 will have a shorter discharge path than the arc tube for a lamp being an alternative of a mini krypton lamp of 60 W type because of having the lamp wattage of 8 W which is smaller than the lamp wattage (12 W) for the alternate lamp of a mini krypton lamp of 60 W type. As a result, the following occurs: (1) the lamp efficiency is reduced by 5% because of the increase in the ratio of electrode loss with respect to positive column input in the arc-tube wattage; and (2) on the other hand, the circumference and the length of the arc tube 520 are made smaller, and so the outer shape of the lamp 500 is made smaller as well.

2. Concrete Example

The lamp 500 requires the quantity of light comparative to the quantity that a mini krypton lamp of 40 W type requires. In view of this, the arc tube 520 is designed so that the number of winding for the entire winding parts 521 and 522 is substantially 3 in total.

The dimensions of the lamp 500 are: a maximum outer diameter D2 of 35 mm, and a length L1 of 67 mm, which are substantially the same as those of a mini krypton lamp of 40 W type (i.e. maximum outer diameter of 35 mm and length of 67 mm) The dimensions of the arc tube 520 are: an outer diameter of 32 mm and a length of 35 mm. The discharge path of the arc tube 520 is 300 mm, at which tube wall loading is set as 0.19 W/cm$^2$.

The glass tube 510 has an inner diameter of 4.0 mm and an outer diameter of 5.6 mm, just as in the case of the alternative of a mini krypton lamp of 60 W type. The glass tube 510 is made of soft glass such as strontium-barium silicate glass, as in the case of the alternative of a mini krypton lamp of 60 W type. Likewise, such characteristics as a location of pitch enlarging positions from the ends of the arc tube, pitch, and winding angle are the same as those of the alternative of a mini krypton lamp of 60 W type.

In the glass tube 510 too, argon as a buffer gas is enclosed at 400 Pa, besides about 2 mg of mercury.

When the lamp 500 was lit with the lamp wattage of 8 W, the luminous flux emitted therefrom was 510 lm, and the lamp efficiency was 63.8 lm/W. The rating life of the present lamp was also 4500-5000 hours, which is about the same as that of the alternate lamp of a mini krypton lamp of 60 W type, described in the first embodiment.

As described above, the lamp 500 has substantially the same size as the mini krypton lamp of 40 W type that the lamp 500 aims to replace (however with a slight difference in shape). The lamp 500 has improved adaptability to the illumination devices for a mini krypton lamp, which is 95%.

So far the present invention has been described by way of the embodiments. However, the present invention should not be limited to specific examples described as the embodiments. For example, the following modification examples are possible.

<Modifications>

1. Lamp

As described above, the lamp according to the present invention is conceived mainly as an alternative of a mini krypton lamp. During the course of examination, it is found that the change in lamp efficiency when the tube wall loading is varied is small as the inner diameter of the arc tube is smaller. This phenomenon is not limited to a double spiral arc tube. The same phenomenon occurs for other shapes of arc tube, such as an arc tube in which a plurality of glass tubes (e.g. four glass tubes) in U-shape are linked to each other, or an arc tube in which a plurality of glass tubes in straight-tube shape are linked to each other to form one discharge path. The same phenomenon also occurs for such shapes of arc tube as a straight-tube shape made by one glass tube, a annular shape formed using one glass tube, a single or double spiral shape whose glass-tube axis exists substantially in one plane, and a single or double spiral shape having a cone-like overall appearance.

Therefore, the present invention is considered applicable in making a smaller arc tube made of a conventional type of glass tube whose tube diameter is 7.5 mm or above, regardless of the shape of the arc tube.

Furthermore, the embodiment deals with an alternate lamp to a mini krypton lamp. However the arc tube of the present invention is also applicable to a fluorescent lamp not including an electronic ballast for lighting the arc tube and having a single base. In other words, the present invention is also applicable to an arc tube for a compact low-pressure mercury discharge lamp. Note that the shapes of the base, the holding member, and the case are not limited to those described in each of the embodiments.

In addition, the arc tube may or may not contain a phosphor applied on its inner surface.

2. Buffer Gas

In the embodiments, argon is enclosed in the arc tube as a buffer gas. However, the buffer gas is not limited to argon, and may be a mixture of two or more kinds of gas.

For example, it has been confirmed that if a mixture of neon (40%) and argon (60%) is enclosed at 700 Pa in the double-spiral arc-tube body 115 of the first embodiment, the luminous flux and the lamp efficiency improve by about 2% compared to a case where only argon is enclosed.

Although the present invention has been fully described by way of examples with references to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An arc tube comprising:

an arc-tube body whose interior space is for forming one bent discharge path; and hot-cathode electrodes provided at ends of the arc-tube body that correspond to ends of the interior space, wherein when an inner diameter of the arc tube is represented as Di mm, and tube wall loading of the arc tube is represented as L W/cm2, rectangular coordinates (Di, L) are confined within a range defined by straight lines connecting points of: (2.5, 0.31), (4.0, 0.35), (5.5, 0.30), (6.5, 0.19), and (2.5, 0.01), in the stated order.

2. The arc tube of claim 1, wherein the arc-tube body is made of a glass tube, and is in a spiral configuration in which at least a part of the glass tube is wound around a predetermined axis.

3. The arc tube of claim 1, wherein the arc-tube body is made of a glass tube, and is in a double spiral configuration in which the glass tube is wound around a predetermined axis from a substantial center to both ends of the glass tube.

4. A low-pressure mercury discharge lamp, comprising: an arc tube of claim 3;

a base; and a lighting circuit for lighting the arc tube using power supplied from an external power source through the base.

5. A low-pressure mercury discharge lamp, comprising:

an arc tube of claim 3; and a base.

6. The arc tube of claim 3 wherein the arc tube has an outer diameter Da of 35 mm, a length La of 40 mm, a length of discharge path of 400 mm and a tube wall loading of 0.22 $W/cm^2$.

7. A low-pressure mercury discharge lamp, comprising:

an arc tube of claim 1;

a base; and a lighting circuit for lighting the arc tube using power supplied from an external power source through the base.

8. A low-pressure mercury discharge lamp, comprising:

an arc tube of claim 1; and a base.

* * * * *